United States Patent [19]

Goldman

[11] Patent Number: 5,071,724

[45] Date of Patent: Dec. 10, 1991

[54] METHOD FOR MAKING COLORED MAGNETIC PARTICLES AND THEIR USE IN ELECTROSTATOGRAPHICD TONER COMPOSITIONS

[75] Inventor: Dov B. Goldman, Secaucus, N.J.

[73] Assignee: Olin Hunt Sub I Corp., Cheshire, Conn.

[21] Appl. No.: 650,983

[22] Filed: Feb. 4, 1991

Related U.S. Application Data

[63] Continuation of Ser. No. 362,893, Jun. 7, 1989, abandoned.

[51] Int. Cl.[5] ..... G03G 9/083; G03G 9/09; G03G 9/093

[52] U.S. Cl. ..... 430/106; 430/106.6; 430/137; 430/138; 428/404; 427/129; 427/130; 427/215

[58] Field of Search ..... 430/106, 106.6, 137, 430/138; 427/129, 130, 215; 428/404

[56] References Cited

U.S. PATENT DOCUMENTS

| | | | |
|---|---|---|---|
| 4,443.527 | 4/1984 | Heikens et al. | 430/39 |
| 4,486,523 | 12/1984 | Hosfeld et al. | 430/106.6 |
| 4,530,893 | 7/1985 | Maekawa et al. | 430/106 |
| 4,536,462 | 8/1985 | Mehl | 430/106 |
| 4,543,382 | 9/1985 | Tsuchida et al. | 524/267 |
| 4,623,602 | 11/1986 | Bakker et al. | 430/106 |
| 4,640,880 | 2/1987 | Kawanishi et al. | 430/106.6 |
| 4,740,443 | 4/1988 | Nakahara et al. | 430/106.6 |
| 4,780,140 | 10/1988 | Franz et al. | |

*Primary Examiner*—Roland Martin
*Attorney, Agent, or Firm*—William A. Simons

[57] ABSTRACT

The present invention provides for a method for the preparation of colored magnetic particles for multicomponent toner compositions in which colors are produced by means of a chemical reaction of different metallic oxides formed on the surface of the magnetic particles.

10 Claims, No Drawings

METHOD FOR MAKING COLORED MAGNETIC PARTICLES AND THEIR USE IN ELECTROSTATOGRAPHICD TONER COMPOSITIONS

"This application is a continuation of application Ser. No. 07/362,893 filed June 7, 1989, now abandoned."

BACKGROUND OF THE INVENTION

1. Field of the Invention

This invention relates to a method of making colored magnetic particles and to these colored magnetic particles as compositions-of-matter and to their use in electrostatic toner compositions.

2. Description of Related Art

Electrostatic charge patterns may be reproduced by means of one of the generally known electrostatographic printing processes, e.g., xerography or by means of a stylus as used for example in a computer printout. The resulting charge pattern may be made visible by means of a toner powder, which by one of the many conventional methods known, is brought into contact with the charge pattern to be developed. These toner powders generally consist of finely divided particles containing a binder and coloring agents.

For some electrostatographic printing applications, it is desirable that the toner powders also contain a magnetic material.

Typical magnetic materials which have appropriate magnetic and electrical properties for use in the preparation of such toner powders include finely divided metal powders of iron, nickel, cobalt, chromium dioxide, gamma ferrioxide and ferrites having a particle size in the range of from about 1 to 50 microns. These materials are, however, dark or black in color which means that they are suitable only for the production of dark or black toner images. Such magnetic particles can not be satisfactorily employed in color electrophotography wherein full color images are produced by the color separation technique using cyan, magenta and yellow colored toners, since obviously the dark color of the magnetic material will have an adverse affect on the quality of the color image.

The main approach in the prior art for solving the color problem inherent with the use of magnetic particles has been to form a coating of a pigment or dyestuff having the appropriate color on the surface of the magnetic particle or on the surface of the toner particle which contains magnetic particles dispersed in a resin binder. For example, Heikens et al (U.S. Pat. No. 4,443,527) discloses the preparation of colored toner particles containing magnetic material wherein a magnetic particle or a toner particle containing a mixture of finely divided magnetic particles dispersed in a fusible binder is first coated with a masking layer composed of a reflecting pigment such as titanium dioxide dispersed in a binder resin, followed by contact of the masked particle with a suitable dye or pigment composition wherein the dye or pigment is caused to coat or become embedded in said masking layer. However, colored renditions produced using this toner material have the disadvantage that their brightness and, in some cases, their color saturation is relatively low, probably as a consequence of the smearing of the toner particles during heat fusion of the image to the transfer substrate. A similar approach is disclosed in Bakker et al (U.S. Pat. No. 4,623,602), except that the masking layer and colored layer contain a yellow fluorescent dye, and binders are used in which dye fluoresces.

Mehl (U.S. Pat. No. 4,536,462) discloses colored magnetic toner powder comprising essentially spherical toner particles containing ferromagnetic particles, highly conductive carbon, at least 5% by weight of a sublimable dyestuff and at least 4% by weight of a surface active agent, wherein the toner particles are preferably structured to have an inside nucleus zone containing the dyestuff and surfactant, and an outside shell zone containing the magnetic material and the highly conductive carbon.

Other approaches to preparing colored toners containing magnetic particles are disclosed in Maekawa et al (U.S. Pat. No. 4,530,893) wherein toner particles are prepared from a mixture of magnetic powder, a red azo pigment and a binder resin in and Hosfeld et al (U.S. Pat. No. 4,486,523) wherein magnetic particles are coated with finely divided opaque polymeric particles which are further mixed with dyes or pigments.

Although these and other prior art approaches for providing colored magnetic toner materials are effective to varying degrees, it is often the case that the color rendition produced by the electrostatographic process is not totally satisfactory. This can arise as a consequence of slight smearing of the toned image thereby exposing portions of the original dark color of the magnetic particles. Also, the application of resinous pigmented coatings to the surface of the magnetic or toner particles can alter the magnetic properties of the toner, and lead to an increase in the electrical resistivity of the toner which can be a negative factor in many applications.

BRIEF SUMMARY OF THE INVENTION

Accordingly, the present invention provides for a method for the preparation of colored magnetic particles for electrostatographic toner compositions in which colors are produced by means of a chemical reaction of different metallic oxides formed on the surface of the magnetic particles. For example, finely divided particles of a base metal or a reducible metal oxide of the base metal are provided as the precursor for a magnetic core material. Even more finely divided particles of a non-reducible metal oxide are deposited or formed on the surface of the core particles to form aggregate particles.

Where the core particles are in the form of the reducible metal oxide, the aggregate particles may be heated under reduction conditions to reduce the core metallic oxide to the base metal and thereby enhance the magnetic and electrical properties of the particles.

Next, the aggregate particles are heated under oxidizing conditions in an oxygen atmosphere for a period of time sufficient to form an Oxide of the metal contained in the core particles on the surface of the core particles without effecting the very fine non-reducible metal oxide particles on the surface of the aggregates. This intermediate product comprises magnetic particles, the interior of each is base magnetic metal and the exterior surface of each is coated with a mixture of the metal oxide of the base metal and the non-reducible different metal oxide which was originally deposited on the surface.

The resulting aggregate particles are then heated at a temperature preferably in excess of about 550° C., and in an inert atmosphere thereby resulting in the formation of a complex oxide as the consequence of the reaction between the different metallic oxides present on the surface of the particle. These complex oxides may be brightly colored and generally differ markedly from the color of the different mixed metal oxides present on the surface of the particle prior to the chemical reaction and the base magnetic metal itself.

Thus, the present invention also provides for varied colored magnetic toner materials wherein the colorant is formed in-situ on the surface of the magnetic particle in the form of metal oxide complexes, thereby obviating the need to use dyes, pigments and polymer materials to mask the color of magnetic particles.

DETAILED DESCRIPTION OF THE INVENTION

The present invention takes advantage of the fact that many mixtures of different metal oxides form brightly colored complexes upon heating at temperatures in excess of about 550° C. in an inert atmosphere, with the precise color a function of the type of complex oxide formed and the temperature employed.

For example, mixed nickel oxide (NiO) and aluminum oxide ($Al_2O_3$) powders will form a green color when heated at 700° to 800° C. in a nitrogen atmosphere. Mixed gamma $Fe_2O_3$ and $Al_2O_3$ powders will form a red powder when heated to 600° C. in a nitrogen atmosphere, and will form a purple powder where heated to 1000° C. in a nitrogen atmosphere.

Thus, the present invention provides a simple and controllable process for coloring the surface of magnetic core particles for use in electrostatographic processes wherein a mixture of different metallic oxides is formed adhering to the surface of the particle and the particle is subsequently heated to give rise to the color-forming reaction between the different oxides on the surface of the particle. Colors obtainable by the present invention are a function of the particular mixed oxides present on the particle surface and the temperature at which such mixed oxides are heated.

The magnetic core particles which may be employed in the present invention include one or a mixture of iron, nickel, cobalt as well as reducible metal oxides such as gamma ferric oxide, nickel oxide and ferrites of the formula $MFe_2O_4$ in which M represents a bivalent metal ion such as iron, manganese, nickel or cobalt, or a mixture of these metals.

The finely divided non-reducible metal oxide which may be deposited on the surface of the magnetic core particles preferably includes the oxides of metals such as and aluminum oxide ($Al_2O_3$), silica, or silicon monoxide (SiO), silicon dioxide ($SiO_2$) and titanium dioxide ($TiO_2$). The most preferred metal oxides are non-reducible, refractory oxides.

In its broader aspects, the present invention provides for the coating of magnetic core particles with sub-micron particles of the non-reducible metal oxide by any suitable technique such as slurry coating or ball mixing. The preferred process however is to deposit these sub-micron particles by precipitation of a water soluble and decomposible metal salt onto the surface of the core particle, followed by heating of the precipitated salt to decompose it into the non-reducible metal oxide. This insures that the deposited metal salt and its decomposition product are present uniformly on the core particle surface and in very finely divided form. For example, finely divided particles of aluminum oxide may be deposited on magnetic core particles by forming a slurry of the core particles in an aqueous solution of aluminum nitrate (e.g. a 30% by weight aqueous solution), followed by air drying the slurry and heating the dried slurry in air at a temperature in excess of the decomposition temperature of the dried salt residue which causes the aluminum oxide decomposition product to precipitate onto the surface of the core particle. Suitable salts for use in this process include the nitrates, sulfates, acetates and other readily decomposible metal salts.

As indicated above, where the magnetic core particle is pure base metal, the next step of the process is to heat the aggregate particles in an oxygen-containing atmosphere for sufficient time and at a temperature to cause the oxidation of the metal surface of the magnetic core particle while leaving the internal base metal of the magnetic core particle unaffected. An intermediate reduction step is required as with a metal oxide starting core material. This oxidation results in the formation of mixed metal oxides on the core particle surface, i.e., the oxide of the base metal and the oxide previously precipitated onto the surface of the particle, while leaving the bulk of the interior of the core particle in the form of the non-oxidized base metal. Such a particle possesses excellent magnetic properties which can be altered and controlled as a function of the thickness of the oxide layer permitted to form on the surface, which in turn is a function of the time and temperature at which the particle is subjected to oxidizing conditions. Preferably, oxidation of the particles is carried out by heating the particles to a temperature within the range of from about 200° to about 400° C. for a period of from about 5 to about 20 minutes in an oxygen containing atmosphere in a tube furnace.

Where the magnetic core particles themselves are in the form of a reducible metallic oxide, e.g., nickel oxide or gamma ferric oxide, then such particles are preferably first reduced to the base metal prior to re-formation of an oxide layer on the surface as described above. This may be accomplished by heating the core particles which are surface coated with the precipitated non-reducible metal oxide in a reducing atmosphere such as hydrogen and to a temperature and for a time sufficient to reduce the core oxide to the base metal, while leaving the non-reducible metal oxide coating substantially unchanged. Preferably reduction is carried out at a temperature within the range of from about 350° to about 550° C. and for a period of time required to complete the reduction to base metals (e.g. about 20–60 minutes).

The core particle reduced to the base metal may then be surfaced oxidized by the process set forth above.

The final step of the process which leads to the formation of the colored magnetic particles of this invention is to heat the surface treated aggregate particles in an inert atmosphere, such as nitrogen gas, for a sufficient time and at a temperature to cause the reaction between the surface oxide of the magnetic core metal and the precipitated oxide, thereby causing the formation of colored magnetic core particles. Generally the particles are heated to temperatures within the range of from about 600° to 1000° C. and for a period of time to complete the reaction.

The particle size of the magnetic core particles treated as set forth above may generally range from about 1 to about 50 microns, with the preferred range being from about 1 to about 20 microns. The oxides which are precipitated onto or formed on the surface of such core particles are generally submicronic in size such that they form a substantially uniform film over the entire surface of the core particle. In general, the particle size of the core particles ranges from about 10 to about 100 or more times as great as the particle size of the oxide coating.

Magnetic particles having varied colored oxide surfaces can be prepared by selecting different magnetic metal cores and non-reducible metal oxide coatings deposited on the surface of such cores. Simple routine experimentation by one skilled in the art within the parameters set forth above will yield colored magnetic particles having colors, hues and shades within most of the visible spectral range.

The colored magnetic particles of the present invention are especially adapted for use in mono-component toner compositions useful in electrostatographic printing applications. Generally such toner compositions are based on a fusible binder polymer having the magnetic particles of this invention uniformly dispersed therein, generally at a level of from about 10 to about 70% by weight of the total toner composition.

The fusible binder polymers that can be used in the compositions of the invention may include the various polymers that conventionally have been employed in dry electrostatic toners. These generally may have a glass transition temperature within the range from 40° to 120° C. Preferably, the toner particles may also have relatively high caking temperature, for example, higher than about 55° C., so that they may be stored without agglomerating. The softening temperature may also be preferably within the range from 40° C. to 200° C., and preferably from 40° C. to 65° C., so that the toner particles can readily be fused to paper receiving sheets. If other types of receiving elements are used, for example, metal printing plates, polymers having a higher softening temperature and glass transition temperature may be used.

Advantageously, the fusible binder comprises 25 percent by weight or more of the toner particles used in the invention. It may be advantageous to use toner particles comprising at least 50 percent by weight, and preferably about 50–85 percent by weight, of the binder polymers.

The fusible binder polymers which may be employed in the toner compositions of the invention may include homopolymers and copolymers of styrene, polycarbonates, resin-modified maleic alkyd resins, polyamides, phenol-formaldehyde resins and derivatives thereof, polyesters, modified alkyd resins, aromatic resins containing alternating methylene and aromatic units such as described in Merrill et al, U.S. Pat. No. 3,809,554, and fusible cross-linked polymers as described in Jadwin et al U.S. Pat. No. 3,938,992.

Especially useful may be styrene-acrylic copolymers of from 40 to 100 percent by weight of styrene or styrene homologs; from 0 to 45 percent by weight of one or more lower alkyl acrylates or methacrylates having from 1 to 4 carbon atoms in the alkyl group; and from 0 to 50 percent by weight of one or more other vinyl monomers, for example, a higher alkyl acrylate or methacrylate (including branched alkyl) and cycloalkyl acrylates and methacrylates) having from 6 to 20 or more carbon atoms in the alkyl group. One preferred styrene-containing copolymer of this kind is prepared from a monomeric blend of 40 to 60 percent by weight styrene or styrene homolog, from 20 to 50 percent by weight of a lower alkyl acrylate or methacrylate and from 5 to 30 percent by weight of a higher alkyl acrylate or methacrylate such as ethylhexyl acrylate. Other preferred fusible styrene copolymers are those which are covalently cross-linked with a small amount of a divinyl compound such as divinylbenzene.

The toner compositions of the present invention also desirably include suitable charge control agents which can provide appropriate positive or negative tribo values as specified for any given electrostatographic apparatus without adversely effecting the final toner color. Illustrative of such agents are quarternary ammonium salts (Bontron P-51) for positive toners and metal salts or complexes such as Bontron E-34, E-82, E-84 and E-88 for negative toners. Organic salts such as ceryl pyridinium chloride and stearyl dimethyl phenethyl ammonium para-totuene sulfonate are also useful charge control agents. Preferably, the charge director,s color should be the same or similar to the desired final color of the toner.

The charge control agents may also be added to the toner in an amount effective to improve the charge properties of the toner composition. Charge control agents improve the charge uniformity of a toner composition, that is, they insure that substantially all of the individual toner particles exhibit a triboelectric charge of the same sign (negative or positive) with respect to a given carrier.

In the toner compositions of the present invention it would be also desirable to employ an amount of at least one charge control agent within the range of 0.01 to 5 weight percent and preferably 0.2 to 3 weight percent based on the total weight of the particulate toner composition. If much lower amounts are used, the charge control agent provides little or no effect. If much higher amounts are used, the net charge of the toner may become unstable or too conductive and the net charge may not be retained. The optimum amount will depend on the components selected for the particular toner composition.

The toner composition may also advantageously contain flow control agents or lubricants. These may include anhydrous silicon dioxide and also silicates such as aluminun silicate, sodium silicate, potassium silicate, magnesium silicate, zinc silicate, alumina powder, and metal stearates such as zinc stearate. The amount of such flow control or lubricant additives added to the toner composition generally anges from about 0.5 to about 5.0% by weight, based on the total toner weight.

A convenient method for preparing toners is melt blending. This involves melting the binder polymer and mixing it with other additives including colored magnetic particles of the present invention on heated compounding rolls. After thorough blending, the mixture is cooled and solidified. The solid mass is broken into small particles and finely ground to form a free-flowing power of toner particles, which may then be further screened to remove large particles.

The toners of this invention maybe used in mono-component toners or may be mixed with a carrier material for two-component developers. Magnetic carrier particles can be used, in addition to the colored magnetic particles of this invention.

The above described toner and developer composition can be used in MICR applications such as described in U.S. Pat. No. 4,517,268.

Developable charge patterns can be prepared by a number of well-known means and be carried, for example, on a light sensitive photoconductive element or a non-light sensitive dielectric-surfaced receiving element. Suitable dry development processes include cascading a cascade developer composition across the electrostatic charge pattern as described in detail in U.S. Pat. Nos. 2,618,551; 2,618,552; and 2,638,416. Another process involves applying toner particles from a magnetic brush developer composition as described in U.S. Pat. No. 3,003,462. Still another useful development process is powder-cloud development wherein a gaseous medium such as air is utilized as a carrier vehicle to transport the toner particles to the electrostatic charge pattern to be developed. This development process is more fully described in U.S. Pat. No. 2,691,345 and U.S. Pat. No. 2,725,304. Yet another development process is for brush development wherein the bristles of a brush are used to transport the toner particles to the electrostatic charge pattern to be developed. This development process is more fully described in Walkup, U.S. Pat. No. 3,251,706.

After imagewise deposition of the toner particles in accord with the process of the invention, the image can be fused as described earlier herein to adhere it to the substrate bearing the toner image. Radiant heaters or heated fuser rolls may be employed to provide fusion heat. If desired, the unfused image can be transferred to another support such as a blank sheet of copy paper and then fused to form a permanent image thereon.

The following examples are illustrative of the preparation of the colored magnetic particles of this invention.

EXAMPLE 1

Thirty grams of black nickel oxide (NiO) having an average particle size of 2 microns was slurried in 30% by weight aqueous solution of aluminum nitrate, $Al(NO_3)_3.9H_2O$. The slurry was air dried to evaporate the water and then heated at 350° C. in air for 10 hours to allow complete decomposition of the aluminum nitrate and to precipitate submicron aluminum oxide ($Al_2O_3$) particles onto the surface of the nickel oxide. The aggregate particles were then exposed to a hydrogen atmosphere at 450° C. for 30 minutes to effect reduction of the nickel oxide to metallic nickel, while leaving the non-reducible $Al_2O_3$ substantially unchanged. After this reduction, the powder was heated in air at 500° C. for 5 minutes in order to effect surface oxidation of the nickel particles, thereby forming particles having mixed aluminum oxide/nickel oxide on the surface. This powder was then heated in a flow of nitrogen gas at a temperature ranging from 700° C. to 800° C. for 60 minutes. Magnetic nickel particles uniformly coated with a green oxide complex were formed.

EXAMPLE 2

Thirty grams of gamma ferric oxide ($Fe_2O_3$) powder having an average particle size of 1 micron was slurried in a 30% by weight aqueous solution of aluminum nitrate. The slurry was air dried to evaporate the water and then heated in air at 350° C. for 12 hours to completely decompose the aluminum nitrate and to precipitate submicron particles of aluminum oxide ($Al_2O_3$) on the surface of the core ferric oxide particles. The aggregate particles were then exposed to a hydrogen atmosphere at 450° C. for 50 minutes to reduce the iron oxide core particles to metallic iron. The reduced aggregate particles were then heated at 300° C. for 5 minutes in an oxygen-nitrogen mixture atmosphere to re-oxidize the surface of the iron core particles to ferric oxide ($Fe_2O_3$), thereby forming metallic iron particles having mixed aluminum oxide/ferric oxide on the surface. This powder was then heated in a flow of nitrogen gas at a temperature of 600° C. for 45 minutes. Magnetic iron particles uniformly coated with a red oxide complex were formed.

EXAMPLE 3

Example 2 was repeated exactly as set forth therein except that, as the final step, the oxide coated core particles were heated in a flow of nitrogen at a temperature of 1000° C. for 45 minutes. Magnetic iron particles uniformly coated with a purple oxide complex were formed.

What is claimed is:

1. A process for making colored magnetic particles comprising:

a) providing magnetic core particles comprising at least one finely divided metal, said particles having an average particle size within the range of from about 1 to about 50 microns, b) forming aggregate particles by depositing finely divided submicron size particles of a non-reducible metal oxide on the surface of said core particles, the metal of said non-reducible metal oxide being different from the metal contained in said core particles, c) heating the aggregate particles of step (b) in an oxygen-containing atmosphere for a sufficient time and at a temperature to cause the oxidation of the surface of said magnetic core particles without affecting the non-reducible metal oxide particles, and d) heating said aggregate particles from step (c) in an inert atmosphere for a sufficient time and at a temperature to cause a reaction between the surface oxide formed on the surface of said core particles and the different metal oxide deposited on the surface of said core particles, thereby causing the formation of surface-colored magnetic core particles.

2. Finely divided colored magnetic particles produced by the process of claim 1.

3. A colored particulate toner composition comprising a uniform mixture of a fusible binder resin having the colored magnetic particles of claim 11 dispersed therein.

4. A process for making colored magnetic particles comprising:

a) providing magnetic core particles comprising at least one reducible metal oxide, said particles having an average particle size within the range of from about 1 to about 50 microns, b) reducing said reducible metal oxide to its base metallic state;

c) forming aggregate particles by depositing finely divided submicron size particles of a non-reducible metal oxide on the surface of said core particles, the metal of said non-reducible metal oxide being different from the metal contained in said core particles, d) heating the aggregate particles of step (c) in an oxygen containing atmosphere for a sufficient time and at a temperature to cause the oxidation of the surface of said magnetic core particles without affecting the non-reducible metal oxide particles, and e) heating said aggregate particles from step (d) in an inert atmosphere for a sufficient time and at a temperature to cause a reaction between the surface oxide formed on the surface of said core particle and the different metal oxide deposited on the surface of said core particle, thereby causing the formation of surface-colored magnetic core particles.

5. The process of claim 4 wherein said deposition of step (c) is carried out by mixing said magnetic core particles with a solution of a water soluble salt of said deposited metal and precipitating particles of said metal in the form of the metal oxide on the surface of said core particles.

6. The process of claim 5 wherein said precipitation is carried out by evaporating said solution of water soluble salt and heating the residuum at a temperature sufficient to decompose said water soluble salt to the metal oxide.

7. The process of claim 4 wherein said magnetic core particles are comprised of a material selected from the group consisting of iron, nickel, cobalt, reducible metal oxides selected from gamma ferric oxide, nickel oxide, and ferrites of the formula $MFe_2O_4$ wherein M represents a bivalent metal, and mixtures thereof.

8. The process of claim 4 where in said deposited submicron particles are oxides selected from the group consisting of aluminum oxide, silicon mono-oxide, silicon dioxide, and titanium oxide.

9. Finely divided colored magnetic particles produced by the process of claim 4.

10. A colored particulate toner composition comprising a uniform mixture of a fusible binder resin having the colored magnetic particles of claim 9 dispersed therein.

* * * * *